US010570527B2

(12) United States Patent
Arvin et al.

(10) Patent No.: US 10,570,527 B2
(45) Date of Patent: Feb. 25, 2020

(54) CONTINUOUS MODIFICATION OF ORGANICS IN CHEMICAL BATHS

(71) Applicant: International Business Machines Corporation, Armonk, NY (US)

(72) Inventors: Charles L. Arvin, Poughkeepsie, NY (US); Christopher D. Muzzy, Burlington, VT (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/012,234

(22) Filed: Jun. 19, 2018

(65) Prior Publication Data

US 2018/0298517 A1 Oct. 18, 2018

Related U.S. Application Data

(62) Division of application No. 15/335,186, filed on Oct. 26, 2016.

(51) Int. Cl.
*C25D 21/14* (2006.01)
*C25D 17/00* (2006.01)
(Continued)

(52) U.S. Cl.
CPC ..... *C25D 21/14* (2013.01); *C25D 17/00* (2013.01); *C25D 21/06* (2013.01); *C25D 21/18* (2013.01); *C25D 3/38* (2013.01)

(58) Field of Classification Search
CPC ..... C25D 21/06; C25D 18/1617; C25D 3/38–40; C25D 7/12–123; C25D 21/14; C25D 21/18; C02F 1/705
See application file for complete search history.

(56) References Cited

U.S. PATENT DOCUMENTS 2,941,902 A * 6/1960 Talmey ..... C23C 18/1617 118/602
RE31,694 E 10/1984 Slominski et al.
(Continued)

FOREIGN PATENT DOCUMENTS

CN 1186875 A 7/1998
JP 2000146303 A * 5/2000
JP 2013188720 A 9/2013

OTHER PUBLICATIONS

Shirai, Machine Translation, JP-2000146303-A (Year: 2000).*
(Continued)

*Primary Examiner* — Brian W Cohen
*Assistant Examiner* — Ho-Sung Chung
(74) *Attorney, Agent, or Firm* — Cantor Colburn LLP; Steven Meyers

(57) ABSTRACT

A chemical bath system includes a reactor tank configured to store a chemical bath solution including at least one organic element, and an organics removing chamber assembly. The organics removing chamber assembly includes at least one sub-chamber that delivers the chemical bath solution from a high-pressure section of a bath circuit to a low-pressure section. The organics removing chamber assembly modifies an amount of the at least one organic element as the chemical bath solution flows therethrough. The chemical bath system further includes an analysis/dosing controller. The analysis/dosing controller outputs a control signal that controls the organics removing chamber assembly to modify the amount of the at least one organic element in the chemical bath solution based on a comparison between an actual amount of the at least one organic element in the chemical bath solution and a desired amount of the at least one organic element.

9 Claims, 5 Drawing Sheets

(51) Int. Cl.

| | |
|---|---|
| ***C25D 21/18*** | (2006.01) |
| ***C25D 21/06*** | (2006.01) |
| ***C25D 3/38*** | (2006.01) |

(56) References Cited

U.S. PATENT DOCUMENTS

| | | | | |
|---|---|---|---|---|
| 4,479,852 | A | 10/1984 | Bindra et al. | |
| 6,551,479 | B1 | 4/2003 | Graham et al. | |
| 6,592,736 | B2 | 7/2003 | Fulton et al. | |
| 6,942,779 | B2 | 9/2005 | Belongia et al. | |
| 7,056,477 | B1 * | 6/2006 | Schwalbe | B01J 19/0093 422/105 |
| 8,301,359 | B1 * | 10/2012 | Sagar | G05B 19/042 123/1 A |
| 8,652,336 | B2 | 2/2014 | Sitkiewitz et al. | |
| 2003/0159937 | A1 | 8/2003 | Gandikota et al. | |
| 2003/0205478 | A1 * | 11/2003 | Blachier | C23C 18/1617 205/98 |
| 2009/0038952 | A1 * | 2/2009 | Tachibana | C25D 3/38 205/296 |
| 2009/0157229 | A1 | 6/2009 | Rulkens et al. | |
| 2014/0272458 | A1 | 9/2014 | Ruan et al. | |
| 2015/0037512 | A1 | 2/2015 | Banno et al. | |
| 2018/0112324 | A1 | 4/2018 | Arvin et al. | |

OTHER PUBLICATIONS

IBM "List of IBM Patents or Patent Applications Treated as Related; (Appendix P)", Filed Jun. 19, 2018, 2 pages.

Clark et al., "Reduction of waste generation and extension of bath life in copper electroplating systems", Proc. 4th Intl. ECS Symp. Environmental. Issues with Materials and Processes for the Electronics and Semiconductor Industries pp. 160-167 (2001).

Gattrell et al., "An electrochemical approach to total organic carbon control in printed circuit board copper sulfate plating baths Part I: Anode performances", Journal of applied electrochemistry, 32, pp. 961-968 (2002).

Gattrell et al., "An electrochemical approach to total organic carbon control in printed circuit board copper sulfate plating baths Part II: Overall system", Journal of applied electrochemistry, 32, pp. 1303-1311 (2002).

Lissens et al., "Electrochemical destruction of organic additives at boron doped diamond electrodes with simultaneous recovery of metals from electroplating effluents:", 132nd Annual meeting of the Minerals, Metals and Materials Society (TMS) pp. 475-484 (2003).

Shen et al., "Precise Chemistry Control Using Cyclic Stripping Voltammetry for Improved Through Silicon via Fill", ECS Transactions, 61(3), pp. 207-217 (2014).

* cited by examiner

CONTINUOUS MODIFICATION OF ORGANICS IN CHEMICAL BATHS

DOMESTIC PRIORITY

This application is a divisional of U.S. patent application Ser. No. 15/335,186, filed Oct. 26, 2016, the disclosure of which is incorporated by reference herein in its entirety.

BACKGROUND

The present invention generally relates to chemical bath systems, and more particularly, to a chemical bath system utilizing chemical bath solution having different organic concentrations.

Chemical bath systems such as electroplating systems, for example, can utilize chemical baths including different organic concentrations to produce metal objects or to form metal-plated coatings. The shapes, sizes, and/or topographies of the metal objects and metal-plated coatings can be controlled and modified based on the ratios of organics added to the chemical bath.

Conventional chemical bath system require one or more additional plating reservoir tanks in order to provide individual chemical baths with different organic ratios for forming each desired shape, size, or topography. However, the implementation of additional plating reservoir tanks increases the cost of the overall system. In addition, conventional chemical bath system require shutting down the system for an extended period time should any of the chemical baths or organics require removal from a given plating reservoir tank. While the system is shut down, the object or coating being formed can realize deformation from the desired shape or topography.

SUMMARY

According to a non-limiting embodiment, a chemical bath system comprises a reactor tank in fluid communication with a chemical bath circuit. The reactor tank is configured to store a chemical bath solution including at least one organic element. The chemical bath circuit includes a high-pressure section that receives the chemical bath solution from the reactor tank, and a low-pressure section that returns the chemical bath solution to the reactor tank. An organics removing chamber assembly includes at least one sub-chamber that delivers the chemical bath solution from the high-pressure section to the low-pressure section. The organics removing chamber assembly is configured to modify an amount of the at least one organic element as the chemical bath solution flows therethrough. An electronic analysis/dosing controller is configured to output a control signal that controls the organics removing chamber assembly to modify the amount of the at least one organic element in the chemical bath solution based on a comparison between an actual amount of the at least one organic element in the chemical bath solution and a desired amount of the at least one organic element.

According to another non-limiting embodiment, a chemical bath system comprises a reactor tank configured to store a chemical bath solution including at least one organic element. A chemical bath circuit includes a high-pressure section that receives the chemical bath solution from the reactor tank, and a low-pressure section that returns the chemical bath solution to the reactor tank. The chemical bath system further comprises an organics removing chamber assembly including at least one sub-chamber that delivers the chemical bath solution from the high-pressure section to the low-pressure section. Each sub-chamber includes an organics removing device configured to continuously modify an amount of the at least one organic element as the chemical bath solution is driven through the chemical bath circuit without interruption.

According to yet another non-limiting embodiment, a method of modifying organic elements in a chemical bath solution of a chemical bath system comprises flowing a chemical bath solution through a chemical bath circuit including a high-pressure section that receives the chemical bath solution from a reactor tank, and a low-pressure section that returns the chemical bath solution to the reactor tank. The method further includes delivering the chemical bath solution from the high-pressure section to the low-pressure section via an organics removing chamber assembly including at least one sub-chamber interposed between the high-pressure section and the low-pressure section. The method further includes continuously modifying an amount of at least one organic element in the chemical bath solution in response to flowing the chemical bath solution through the organics removing chamber assembly without flushing the chemical bath solution from the reactor tank.

BRIEF DESCRIPTION OF THE DRAWINGS

The subject matter which is regarded as embodiments of the invention is particularly pointed out and distinctly claimed in the claims at the conclusion of the specification. The foregoing and other features of the embodiments of the invention are apparent from the following detailed description taken in conjunction with the accompanying drawings in which:

DETAILED DESCRIPTION

The ratios of organic elements included in a chemical bath solutions such as electrolytic copper baths, electroless baths, pharmaceutical baths, for example, of a chemical bath system can be modified to produce metal objects or from metal-plated coatings (e.g., metal platings) having various shapes, sizes, and/or topographies. The metal objects and/or metal-plated coatings can be employed in various technical fields including, but not limited to, semiconductor fabrication, C4 plating, electroless plating, electrolytic plating, medical device fabrication, pharmaceutical applications, and various chemical operations that create organic species for various applications. The ratios of organic elements are modified by not only adding organics to the bath solution but also can require removing certain organic elements from the bath solution. However, conventional chemical bath systems fail to provide a convenient and expeditious means for removing desired organic elements from the bath solution. For instance, when utilizing bath solution solutions composed of copper sulfate or nickel sulfate, the organic elements can be removed using peroxide and UV light. This process, however, requires shutting down the reservoir tank (s) containing the bath solution for at least an entire day, and then re-validating the subsequent bath to ensure the undesired organic elements have been removed. In another instance where a non-fully oxidized counter ion bath solution composed of MSA, sulfate, or sulfite is employed, for example, a substantial amount of the bath solution (e.g., 70% of the bath) must be removed in order to replenish the bath solution with fresh chemistry. The substantial change in bath solution volume, however, causes significant costs for storage of the chemistry in order to avoid disposal costs.

Various non-limiting embodiments provide a chemical bath system including an organics removing chamber assembly that continuously modifies the organic elements of a bath solution. Unlike conventional systems, the organics removing chamber assembly of the chemical bath system according to at least one embodiment includes a plurality of organic removing sub-chambers that enable constant removal of organic elements from a bath solution. In at least one embodiment, a power supply can apply different polarities (e.g., positive or negative polarity) to the bath solution flowing through one or more organics remove sub-chambers. As the bath solution flows past the polarized working electrode of the sub-chamber, organic elements can be constantly removed from the bath. Therefore, the bath solution can be continuously modified without shutting down the chemical bath system thereby improving the formation of the metal object or metal plating. In two other embodiments, bead-meshings are configured to remove organic elements. The bead-meshings include a plurality of beads formed as solid metal beads or inert beads coated with a metal film.

Figure 1:
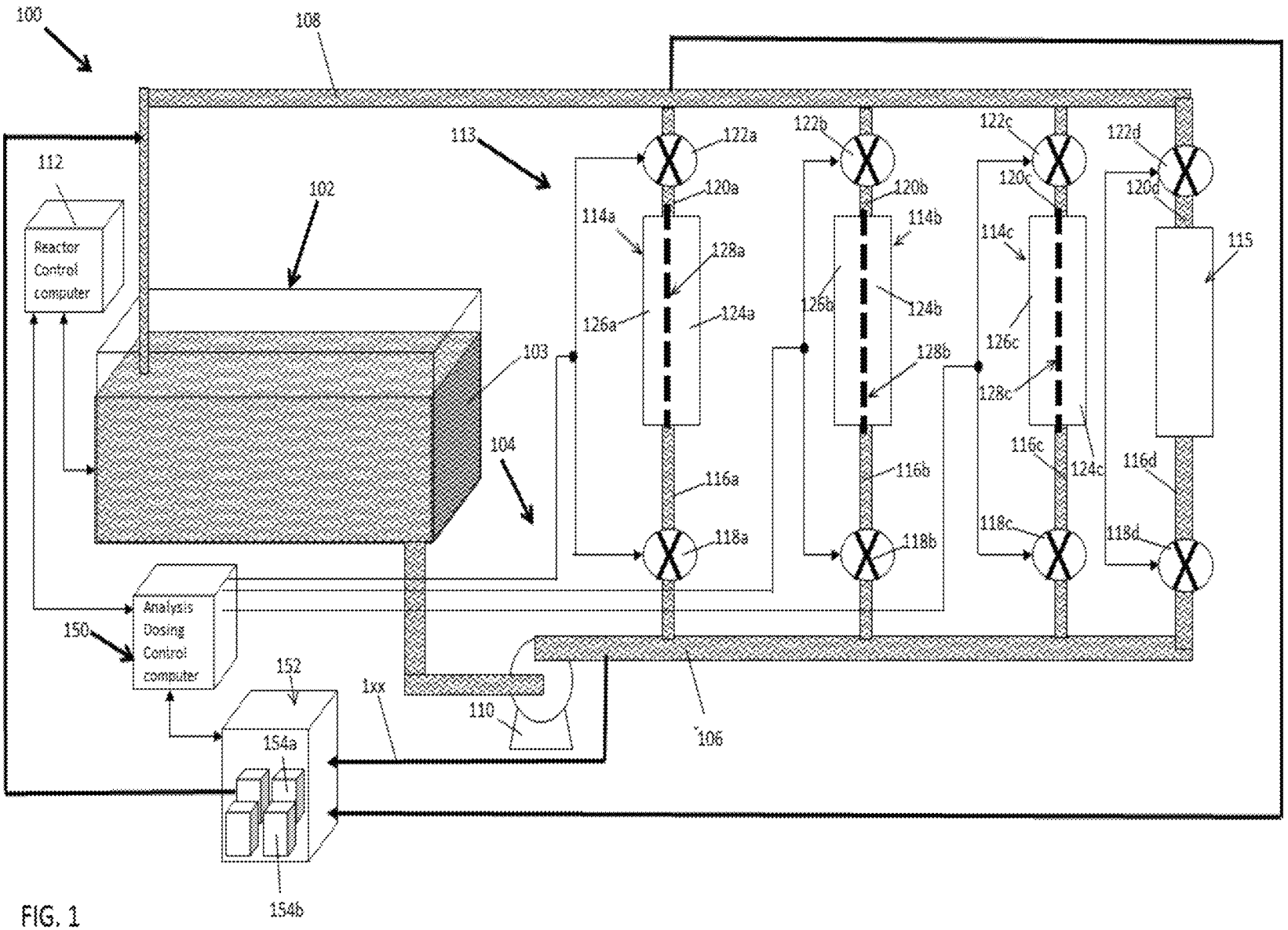
FIG. 1 is a diagram of a chemical bath system according to a non-limiting embodiment.

Turning now to FIG. 1, a chemical bath system 100 is illustrated according to a non-limiting embodiment. The chemical bath system 100 includes a reactor tank 102, an electronic reactor controller 112, an organics removing chamber assembly 113, and an electronic analysis/dosing controller 150. The reactor tank 102 is configured to store a chemical bath solution 103 including at least one organic element such as accelerators, levelers and polymers in a typical copper (Cu) plating bath solution, for example. The chemical bath solution 103 is circulated (i.e., driven) through a bath circuit 104 via a pump 110. The bath circuit 104 includes a high-pressure section 106 that receives the chemical bath solution 103 from the reactor tank 102 (e.g., from the output of the pump 110), and a low-pressure section 108 that returns the chemical bath solution 103 to the reactor tank 102. In at least one embodiment, the chemical bath solution 103 can be continuously modified such adding or removing one or more organics elements, for example, without interrupting the flow of the chemical bath solution 103 through the bath circuit 104 as described in greater detail below. By avoiding interruption of the chemical bath solution flow and/or avoiding flushing of the reactor tank 102, the integrity of the object being formed, plated, etc. can be maintained, thereby improving the overall quality of the final product.

An object (not shown in FIG. 1) to be formed, plated, etc., is disposed in the reactor tank 102 to be placed in fluid communication with the bath solution 103. In at least one embodiment, a power supply (not shown in FIG. 1) may include one terminal connected to a wafer (not shown in FIG. 1) in fluid communication with the solution 103 and a second terminal connected to a counter electrode (not shown in FIG. 1) in fluid communication with the solution 103. In at least one embodiment, the first terminal/wafer may operate as a cathode while the second terminal/counter electrode operates as an anode. In this manner, the power supply can supply a direct current to the anode, oxidizing the metal atoms that it comprises and allowing them to dissolve in the solution 103. At the cathode, the dissolved metal ions in the solution 103 are reduced at the interface between the solution and the cathode so as to form the object or facilitate a metal plating process.

The electronic reactor controller 112 communicates with the analysis/dosing controller 150 and with the reactor tank 102 to perform various operations including, but not limited to, determining an existing volume of the bath solution 103, and selectively applying power to the reactor, the powers supply used to plate the parts and/or the pump 110 so as to control the overall operation of the system 100.

The chamber assembly 113 is configured to continuously vary an amount of one or more organic elements included in the bath solution 103. The chamber assembly 113 includes at least one sub-chamber. As illustrated in FIG. 1, for example, the chamber assembly 113 may include three separate and individual organics removal sub-chambers 114*a*-114*c*. However, the chamber assembly 113 is not limited thereto, and may have more or less sub-chambers. The organics removing sub-chambers 114*a*-114*c* are capable of continuously modifying the composition of the bath solution 103 without requiring shut-down of the chemical bath system 100. The chamber assembly 113 may also include a by-pass chamber 115. The by-pass chamber can be controlled by the analysis/dosing controller 150 to allow all or a portion of the bath solution 103 to by-pass the sub-chambers 114*a*-114*c* such that the chemistry composition of the bath solution flowing therethrough is not modified or altered. Unlike conventional chemical bath systems, the organics removing sub-chambers 114*a*-114*c* along with the by-pass chamber 115 can be independently adjusted with respect to one another via the analysis/dosing controller 150 to enable constant modification of organic elements without requiring shutdown of the system as described in greater detail below.

The sub-chambers 114*a*-114*c* and the by-pass chamber 115 include an inlet 116*a*-116*d* and an outlet 120*a*-120*d*. The inlets 116*a*-116*d* are in fluid communication with the high-pressure section 106 via an inlet valve 118*a*-118*d*. The outlets 120*a*-120*d* are in fluid communication with the low-pressure section 108 via an outlet valve 122*a*-122*d*.

The analysis/dosing controller 150 is in signal communication with the chamber assembly 113 and a and is configured to output at least one valve control signal to adjust a position of one or more of the inlet valves 118*a*-118*d* and/or one or more of the outlet valves 122*a*-122*d*. During operation, the analysis/dosing controller 150 controls the chamber assembly 113 so as to remove one or more organic elements from the bath solution 103 as the bath solution 103 flows through one or more of the sub-chambers 114*a*-114*c* as described in greater detail below.

Unlike conventional chemical bath systems, the analysis/dosing controller 150 can control the inlet valves 118*a*-118*d* and/or the outlet valves 122*a*-122*d* such that some of the bath solution 103 remains circulating through the circuit 104, while a portion of the bath solution 103 is delivered through the chamber assembly 113. In the example illustrated in FIG. 1, one chamber (e.g., 114*a*) can be rebuilt while the remaining sub-chambers (e.g., 114*b*-114*c*) remain in service. In at least one embodiment, one of the remaining sub-chambers (e.g., 114*c*) can be removed from service (e.g., both valves 118*c*-122*c* closed) if processing interruptions occur. Accordingly, organic elements can be constantly added or removed without shutting down system 100 or shutting the tank 102 to flush all or a portion of the bath solution 103.

The analysis/dosing controller 150 can also determine a first pressure of one or more of the sub-chambers 114*a*-114*c*, determine a second pressure of one or more of the sub-chambers chambers 114*a*-114*c*, and output a diagnostic signal to the reactor controller 112 requesting replacement of the coated bead-meshing in response to the second pressure decreasing below a pressure threshold value. The pressures can be delivered via a pressure sensor (not shown) disposed in the sub-chambers 114*a*-114*c*. In this manner, the sub-chambers 114*a*-114*c* are ensured to constantly operate at a sufficient pressure to form the desired metal object or form the desired plating without resulting in defects caused by undesired pressure drops.

The system 100 further includes a dosing analysis unit 152 that is in fluid communication with the high-pressure section 106 and the low-pressure section 108. The dosing analysis unit 152 includes one or more dosing vials 154*a*-154*b* that receive a portion of the bath solution 103. For instance, a first vial 154*a* receives a first portion of the plated bath solution 103 from the high-pressure section 106 and a second vial 154*b* that receives a second portion of the plated bath solution 103 from the low-pressure section 108.

The analysis/dosing controller 150 is in fluid communication with the dosing analysis unit 152 and can receive samples of the bath solution contained in the dosing vials 154*a*-154*b*. The dosing analysis unit 152 can also be in signal communication with the analysis/dosing controller 150 so as to analyze the dosing vials 154*a*-154*b* locally, and output a signal to the analysis/dosing controller 150 indicating various characteristics, properties, and/or chemical compositions of the bath solution contained in the vials 154*a*-154*b*. In this manner, the analysis/dosing controller 150 can determine a concentration of organic elements in the bath solution 103.

For instance, the analysis/dosing controller 150 is capable of determining a first amount of the organic elements in the bath solution 103 based on the first portion of the plated bath solution contained in the first vial 154*a*, and a second amount of the organic elements in the bath solution based on the second portion of the plated bath solution contained in the second vial 154*b*. Accordingly, the analysis/dosing controller 150 can calculate an amount of organic elements removed from the bath solution 103 or added to the bath solution 103 based on a difference between the first amount of the organic elements sampled from the high-pressure section (i.e., contained in the first vial 154*a*) and the second amount of the organic elements sampled from the low-pressure section 108 (i.e., contained in the second vial 154*b*) of the bath solution which is returned to the to the tank 102 after flowing through the chamber assembly 113.

Figure 2:
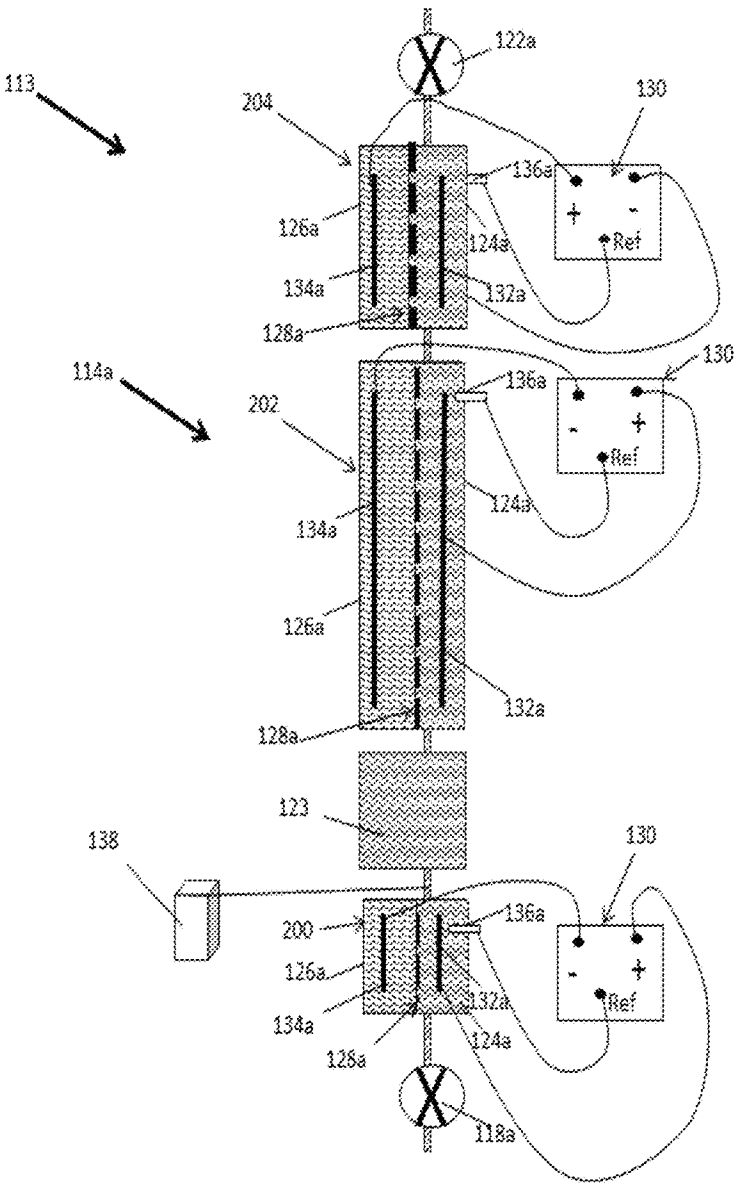
FIG. 2 is a diagram of an organics removing chamber assembly included in the chemical bath system according to a non-limiting embodiment.

In at least one embodiment illustrated in FIG. 2, the sub-chambers 114*a*-114*c* include a first electrically charged chamber 200 (e.g., first positively charged chamber), a second electrically charged chamber 202 (e.g., second positively charged chamber), and a third electrically charged chamber 204 (e.g., a first negatively charged chamber 204). The chambers 200-204 can be separated from one another to facilitate removal of different types of organic elements from the bath solution 103 as described in greater detail below. Although three electrically charged chambers 200-204 are shown, more or less chambers can be employed deepening on the number and/or type of organic elements to be removed from the bath solution 103.

In addition, a species dosing unit 138 and a mixing reactor 123 can be employed with one or more of the sub-chambers 114*a*-114*c*. The species dosing unit 138 is configured to inject a species element such as chloride (Cl), for example, into the bath solution 103. Although the species dosing unit 138 is illustrated as being disposed downstream from the first chamber 200, the location of the species dosing unit 138 is not limited thereto. The mixing reactor 123 is interposed between one or more of the chambers 200-202. In an embodiment, a static mixer 123 is employed. The static mixer 123 includes a plurality of baffles (not shown) formed inside the mixer housing. The baffles extend along the length of the static mixer (i.e., parallel with the flow of the bath solution 103 through the charged chambers 200-204) so as to mix the bath solution 103 as it flows through the mixer 123.

Still referring to FIG. 2, each of the chambers 200-204 can be electrically connected to one or more power supplies 130 such that an electrical polarity is applied to the bath solution 103 flowing therethrough.

For instance, an electrical polarity can be applied to the bath solution 103 by disposing electrodes in the chambers 200-204, and connecting the electrodes to the output of the power supplies 130. For instance, each chamber 200-204 includes a working section 124*a*-124*c* and a counter section 126*a*-126*c* separated from the working section 124*a*-124*c* via an organics removing device 127. In at least one non-limiting embodiment, the organics removing device 127 is an ionic membrane 128*a*-128*c*. The counter section 126*a*-126*c* is configured to store either an anolyte solution (i.e., having a positive charge) or a catholyte solution (i.e., having a negative charge) to receive the at least one organic element in response to flowing the bath solution 103 through the working section 124*a*-124*c*. The power supply 130 is connected to a working electrode 132*a*-132*c* disposed in the working section 124*a*-124*c* and a counter electrode 134*a*-134*c* disposed in the counter section 126*a*-126*c*. In at least one embodiment, the power supply 130 is also connected to a reference electrode 136*a*-136*c* that is disposed in the working section 124*a*-124*c*. The reference electrode 136*a*-136*c* controls the proper voltage provided to the working electrode 132*a*-132*c* to remove an organic element(s) of interest Electrical current and anions move from the working section 124*a*-124*c* to the counter section 126*a*-126*c* (or vice versa) based on the electrical potential across the 200-204 (i.e., based on the electrical potential applied to the working electrode 132*a*-132*c* and the counter electrode 134*a*-134*c*). In at least one embodiment, organic elements can be physically attached to the working section 124*a*-124*c* when the solution passes by the working section 124*a*-124*c* and it is polarized correctly as measured by the reference electrode 136*a*-136*c*. For instance, the electrodes either take or add an electron(s) to a specie(s), and the species moves from the first electrode to the opposing electrode so as to give up or take an electron from within the opposing electrode.

The first electrically charged chamber 200 can apply an electrically positive polarity to the bath solution 103 to remove a first organic element from the bath solution 103. The second electrically charged chamber 202 can be formed with a length that is greater than the length of the first electrically charged chamber 200 while maintaining the first polarity (e.g., positive polarity) on the bath solution 103. In this manner, the second electrically charged chamber 202 can remove at least one species element and trace metal ions from the bath solution 103. The third electrically charged chamber 204 can reverse the polarity of the bath solution 103 (e.g., apply a negative polarity). In this manner, the third electrically charged chamber 204 can remove a second organic element from the bath solution 103 which is different from the first organic element removed by the first charged chamber 200 and/or the second charged chamber 202.

Figure 3:
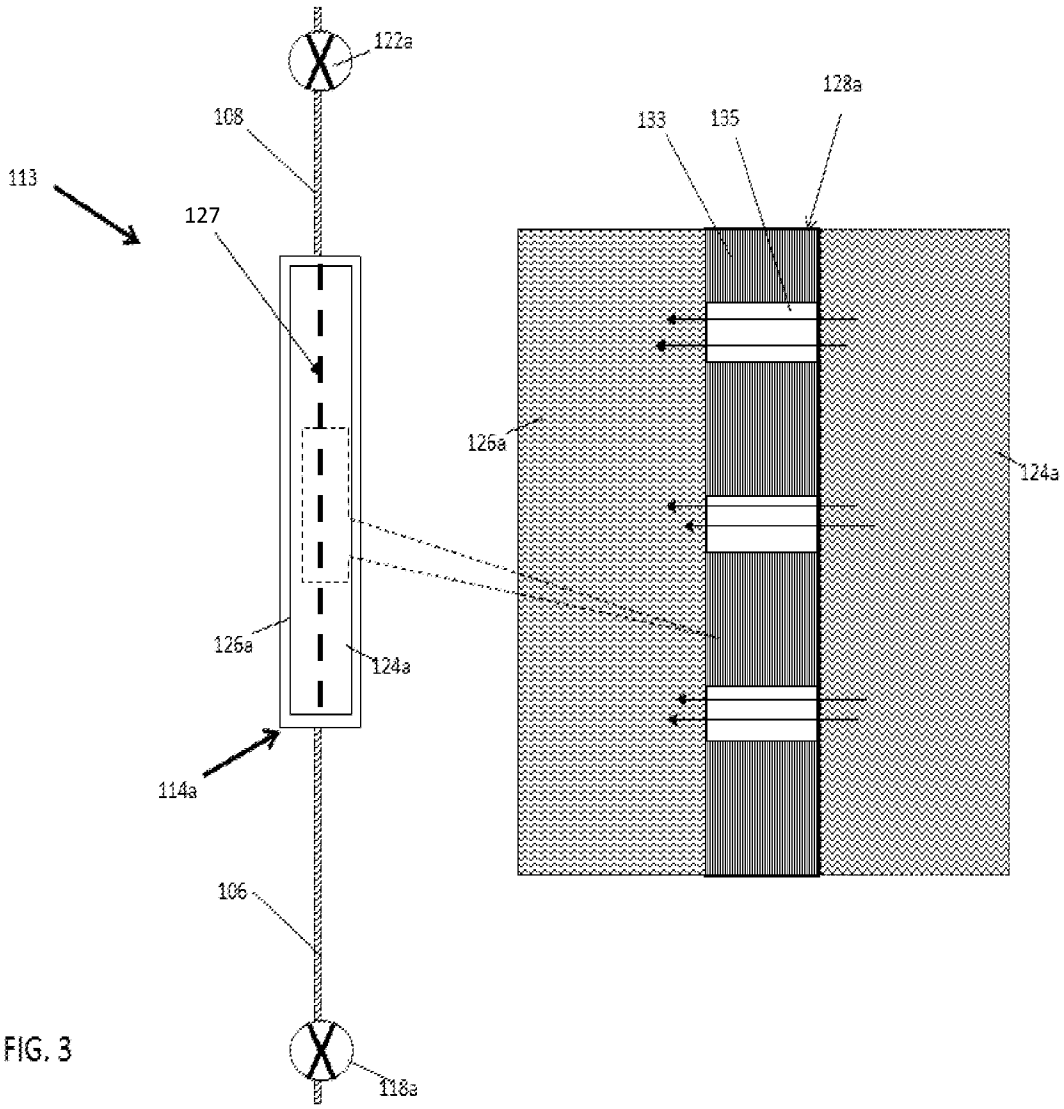
FIG. 3 is a diagram of a sub-chamber including an ionic membrane separating a working electrode from a counter electrode.

As described above, the working section 124*a*-124*c* can be separated from the counter section 126*a*-126*c* via an ionic membrane 128*a*-128*c* (see FIG. 3). The membrane 128*a*-128*c* has an arrangement of interlocking strands 133 with spaced, varying openings 135 therebetween. In at least one embodiment, the membrane 128*a*-128*c* is composed of a sulfonated tetrafluoroethylene based fluoropolymer-copolymer, for example, and includes a backbone of a particular specie such as sulfate that allows only certain ions to move through. The membrane 128*a*-128*c* can be configured as a anionic membrane (i.e., only anions pass therethrough) or a cationic membrane (i.e., only cations pass therethrough). For example, the membrane 128*a*-128*c* can be configured as an anionic membrane 128*a*-128*c* so that it prevents metal ions from transferring from the bath solution 103 into the electrolyte in contact with the counter electrode 134*a*-134*c* electrode.

Figure 4:
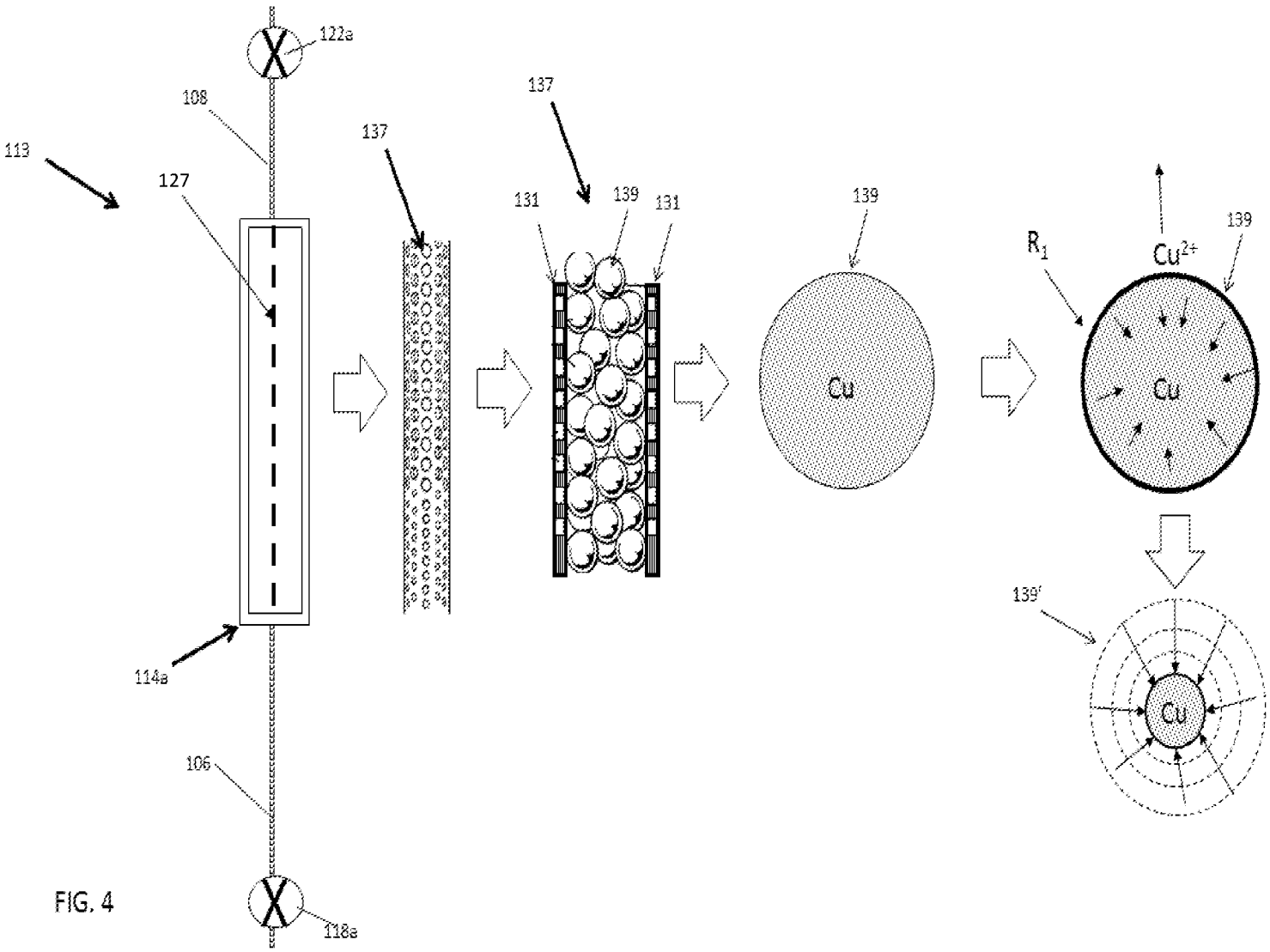
FIG. 4 is a diagram of a sub-chamber with a bead-meshing.

In at least one non-limiting embodiment, the organics removing device 127 is a bead-meshing 137 (see FIG. 4). The bead-meshing 137 includes a plurality of metal beads 139 (e.g., copper beads) wrapped in a porous meshing 131. In at least one embodiment, the beads are formed from the same metal included in the bath solution 103. The meshing 131 and the metal beads 139 can also be electrically polarized relative to the outer wall of the chamber (i.e., positively charged or negatively charged) to enhance the removal rate of organic elements from the bath solution 103

As further illustrated in FIG. 4, the organic elements ($R_1$) such as accelerators, levelers and polymers, for example, react with the material of the beads 139 such that the metal beads 139 lose electrons and begin to dissolve. Thus, the size of the metal beads 139' decrease as the metal material of the beads metal beads 139' dissolve as further illustrated in FIG. 4. In turn, the smaller metal beads 139' cause an increase in the pressure drop across one or more of sub-chambers 114*a*-114*c*. When the pressure drop across the a sub-chamber 114*a*-114*c* causes the outlet pressure to fall below a pressure threshold, the metal beads 139' and/or the meshing 131 may be replaced. Pressure sensors (not shown) can be included in the sub-chambers 114*a*-114*c* on both the inlet and outlet sides of a give sub-chamber, for example, and can be configured to output a pressure signal to the analysis/dosing controller 150 indicating the monitored pressure drop of a given sub-chamber 114*a*-114*c*. A flow meter (not shown) can also be included in each sub-chamber 114*a*-114*c*, and can be configured to output a flow rate signal to the analysis/dosing controller 150 indicating the rate of bath solution through a given sub-chamber 114*a*-114*c*.

Figure 5:
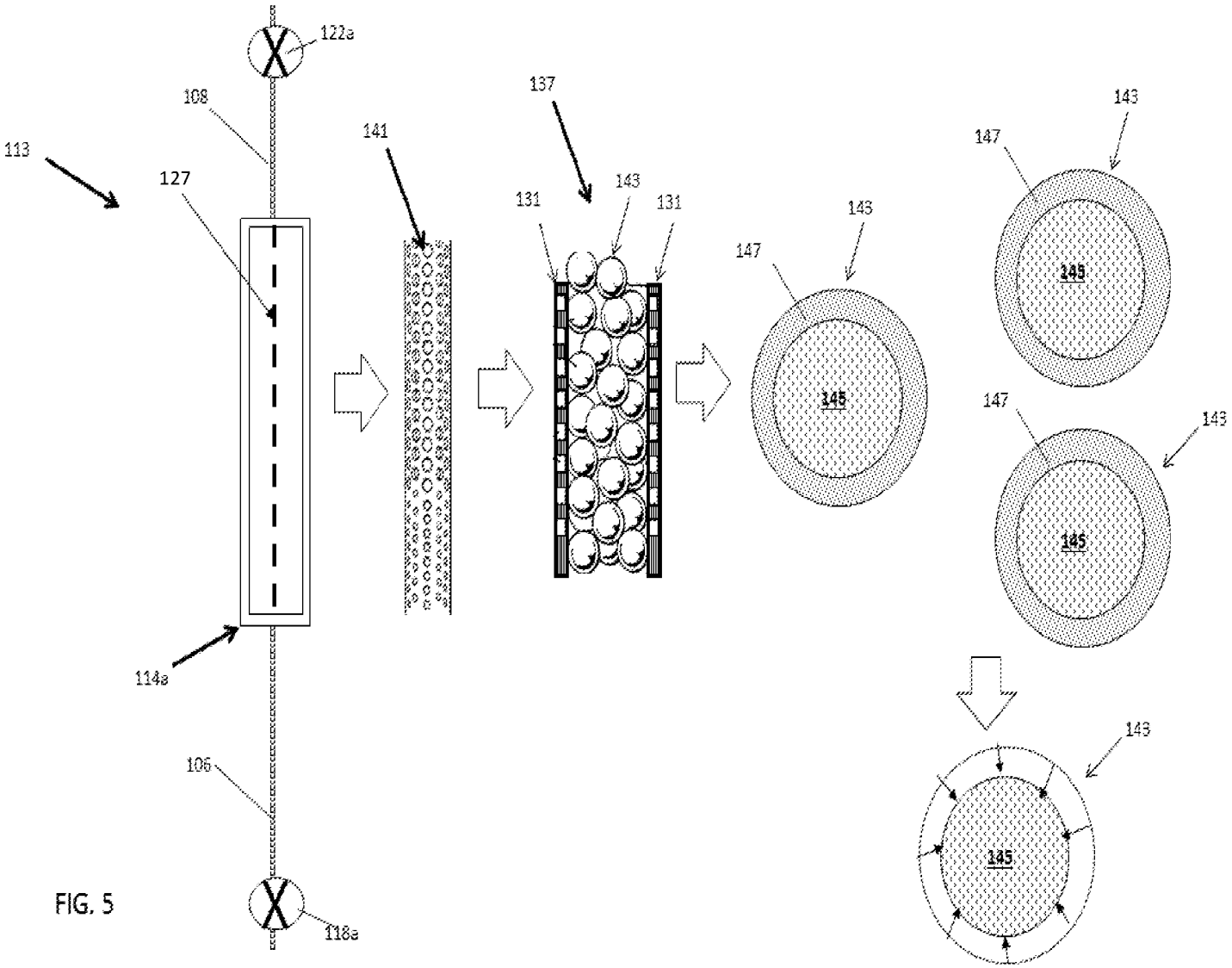
FIG. 5 is a diagram of a sub-chamber including a coated bead-meshing according to a non-limiting embodiment.

In at least one non-limiting embodiment, the organics removing device 127 is a coated bead-meshing 141 (see FIG. 5). The coated bead-meshing 141 includes a plurality of coated beads 143 encased in the meshing 131. Each coated bead 143 includes a core 145 and a film 147 formed on the outer surface of the core 145. In an embodiment, the core 145 is composed of an inert material such as glass, while the film 147 is composed of a soluble metal material that matches the metal of the bath (e.g., copper, tin, nickel, etc.). In this manner, the film 147 is removed until reaching the core 145. Accordingly, the size-reduction of the coated beads can be regulated, thereby regulating the pressure drop across the sub-chambers 114*a*-114*c*.

As described above, various non-limiting embodiments provide a chemical bath system that includes one or more organic removal sub-chambers assembly that continuously modifies the level of organic elements in a bath solution. Unlike conventional chemical bath systems, the organic removal chamber assembly described herein includes a plurality of sub-chambers that can be independently adjusted with respect to one another to enable constant modification of organic elements without requiring shutdown of the system. For instance, instead of shutting down the system for an extended amount of time to flush and rebuild the reactor tank, one sub-chamber included within the organic removal chamber assembly can be closed and rebuilt while one or more remaining sub-chambers remain in service (i.e., allow bath solution to flow through a given open chamber) to continue modifying the bath solution flowing through the bath circuit. Accordingly, throughput is improved while avoiding component deformation typically caused by a system shutdown.

As used herein, the term "module" refers to an application specific integrated circuit (ASIC), an electronic circuit, a microprocessor, an electronic hardware computer processor (shared, dedicated, or group) and memory that executes one or more software or firmware programs, a combinational logic circuit, a microcontroller including various inputs and outputs, and/or other suitable components that provide the described functionality. The module can be configured to execute various algorithms, transforms, and/or logical processes to generate one or more signals for controlling a component or system. When implemented in software, a module can be embodied in memory as a non-transitory machine-readable storage medium readable by a processing circuit (e.g., a microprocessor) and storing instructions for execution by the processing circuit for performing a method. A controller refers to an electronic hardware controller including a storage unit capable of storing algorithms, logic or computer executable instruction, and that contains the circuitry necessary to interpret and execute instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A chemical bath system, comprising:

a reactor tank configured to store a chemical bath solution including at least one organic element;

a chemical bath circuit including a high-pressure section that receives the chemical bath solution from the reactor tank, and a low-pressure section that returns the chemical bath solution to the reactor tank;

an organics removing chamber assembly including a plurality of sub-chambers that delivers the chemical bath solution from the high-pressure section to the low-pressure section, the plurality of sub-chambers are arranged in parallel with one another, the organics removing chamber assembly configured to modify an amount of the at least one organic element as the chemical bath solution flows therethrough; and an analysis/dosing controller configured to output a control signal that controls the organics removing chamber assembly to modify the amount of the at least one organic element in the chemical bath solution based on a comparison between an actual amount of the at least one organic element in the chemical bath solution and a desired amount of the at least one organic element, wherein each of the plurality of sub-chambers includes an organics removing device configured to continuously modify an amount of the at least one organic element, the organics removing device incorporating a coated bead-meshing that includes a plurality of coated beads encased in a porous meshing.

2. The chemical bath system of claim 1, wherein the analysis/dosing controller monitors a pressure of the at least one plurality of sub-chambers and outputs a diagnostic signal in response to the pressure of the at least one sub-chamber decreasing below a pressure threshold indicating replacement of at least one organics removing device corresponding to the at leats one of the plurality of sub-chambers blow the pressure threshold to control the organics removing chamber assembly to continuously vary an amount of the at least one organic element included in the chemical bath solution.

3. The chemical bath system of claim 2, wherein the organics removing chamber assembly has an inlet in fluid communication with the high-pressure section via an inlet valve and has an outlet in fluid communication with the low-pressure section via an outlet valve.

4. The chemical bath system of claim 3, wherein the analysis/dosing controller controls at least one of the inlet valve and the outlet valve to vary the amount of the chemical bath solution through the organics removing chamber assembly to control the desired amount of the at the at least one organic element.

5. The chemical bath system of claim 1, wherein the organics removing chamber assembly modifies the amount of the at least one organic element in the chemical bath solution.

6. The chemical bath system of claim 5, wherein the organics removing chamber assembly modifies the amount of the at least one organic element in the chemical bath solution by removing a portion of the at least one organic element while continuously flowing the chemical bath solution through the chemical bath circuit.

7. A chemical bath system, comprising:

a reactor tank configured to store a chemical bath solution including at least one organic element;

a chemical bath circuit including a high-pressure section that receives the chemical bath solution from the reactor tank, and a low-pressure section that returns the chemical bath solution to the reactor tank; and an organics removing chamber assembly including at least one sub-chamber that delivers the chemical bath solution from the high-pressure section to the low-pressure section, wherein each of the at least one sub-chambers includes an organics removing device configured to continuously modify an amount of the at least one organic element, the organics removing device incorporating a coated bead-meshing that includes a plurality of coated beads encased in a porous meshing.

8. The chemical bath system of claim 7, wherein each sub-chamber includes an organics removing device that continuously modifies an amount of the at least one organic element as the chemical bath solution is driven through the chemical bath circuit without interruption.

9. The chemical bath system of claim 7, wherein each of the plurality of coated beads includes as core comprising an inert material and a metal film formed on an outer surface of the core.

* * * * *